US005765812A

United States Patent [19]

Guenther

[11] Patent Number: 5,765,812

[45] Date of Patent: Jun. 16, 1998

[54] MODULAR SUPPORT RAIL ASSEMBLY

[75] Inventor: Torbett B. Guenther, 8992 Tamarack Ct., Plymouth, Mich. 48170

[73] Assignees: Torbett B. Guenther; Dolores Guenther, both of Plymouth, Mich.

[21] Appl. No.: 340,650

[22] Filed: Nov. 16, 1994

[51] Int. Cl.[6] ..... E04H 17/14

[52] U.S. Cl. ..... 256/69; 256/65; 403/365; 403/368; 403/370

[58] Field of Search ..... 256/59, 65, 69; 403/365, 366, 367, 368, 370, 371, 374, 409.1, 108, 205

[56] References Cited

U.S. PATENT DOCUMENTS

| | | | |
|---|---|---|---|
| 593,729 | 11/1897 | Skinner | 403/108 |
| 809,670 | 1/1906 | Covert | 182/92 |
| 1,821,182 | 9/1931 | Hoppes | 403/205 X |
| 2,147,028 | 2/1939 | Gundelfinger | 16/125 |
| 2,542,967 | 2/1951 | Waechter | 403/368 X |
| 2,815,972 | 12/1957 | Lagervall | 403/7 |
| 2,840,402 | 6/1958 | Hassel | 403/370 |
| 2,940,719 | 6/1960 | Taubman | 257/251 |
| 2,991,096 | 7/1961 | Davidson | 403/365 |
| 2,999,706 | 9/1961 | Wilcox | 403/370 |
| 3,278,209 | 10/1966 | Winikoff | 403/219 |
| 3,804,542 | 4/1974 | Hammerschmidt | 403/264 |
| 4,013,372 | 3/1977 | Lay et al. | 403/237 |
| 4,134,703 | 1/1979 | Hinners | 403/374 X |
| 4,193,586 | 3/1980 | Guenther | 256/69 |
| 4,415,141 | 11/1983 | Guenther | 256/69 |
| 4,683,609 | 8/1987 | Trubiano | 16/114 |
| 4,706,367 | 11/1987 | Garringer | 403/365 X |
| 4,737,047 | 4/1988 | Oshita | 403/191 |
| 4,802,785 | 2/1989 | Richards | 403/27 |
| 4,810,144 | 3/1989 | Martelli | 411/182 |
| 4,890,954 | 1/1990 | Richards | 403/260 |
| 4,952,092 | 8/1990 | Ballerstein | 403/174 |
| 5,193,786 | 3/1993 | Guenther | 256/69 |
| 5,419,650 | 5/1995 | Hoshino | 403/370 |
| 5,433,551 | 7/1995 | Gordon | 403/22 X |
| 5,477,747 | 12/1995 | Cheng | 403/374 X |
| 5,566,926 | 10/1996 | Voigt | 256/65 X |
| 5,647,684 | 7/1997 | Chen | 403/370 |

FOREIGN PATENT DOCUMENTS

| | | | |
|---|---|---|---|
| 2904776 | 8/1980 | Germany . | |
| 4122047 | 1/1993 | Germany | 256/59 |
| 300460 | 12/1990 | Japan . | |
| 354239 | 7/1961 | Switzerland | 403/205 |

*Primary Examiner*—Brian K. Green
*Assistant Examiner*—Andrea Chop
*Attorney, Agent, or Firm*—Barnes, Kisselle, Raisch, Choate, Whittemore & Hulbert

[57] ABSTRACT

A modular support rail assembly that includes a rail having an open end with an internal wall surface and an elbow with facility at one end for mounting to a support, such as a building wall, and an opposing end with an internally threaded opening. An insert construction is disposed within the open end of the rail, and a fastener extends through the insert into the internally threaded opening in the elbow. An expansible ring is carried by the insert structure within the open end of the rail, and is responsive to compression of the insert structure upon tightening of the fastener to expand radially outwardly against and frictionally engage the internal wall surface of the rail. The rail is thereby firmly fastened to the elbow.

10 Claims, 2 Drawing Sheets

MODULAR SUPPORT RAIL ASSEMBLY

The present invention is directed to a modular support rail assembly of a type adapted to be affixed to a wall or other support surface for use by elderly or handicapped persons.

BACKGROUND AND SUMMARY OF THE INVENTION

U.S. Pat. No. 5,193,786, assigned to the assignee hereof, discloses a modular support rail assembly that includes a length of tubular material attached to at least one plastic elbow section that connects the tube to a wall. The length of tubular material is attached to the plastic elbow by an insert disposed within an end of the tube, and a hex-head bolt that extends through the insert into an internally threaded opening in the elbow. A spacer is secured between the tubular length and the elbow.

It is a general object of the present invention to provide an improved modular support rail assembly generally of the type disclosed in the noted patent, and which is economical and easy to fabricate and assemble.

A modular support rail assembly in accordance with the present invention includes a rail having an open end with an internal wall surface and an elbow with facility at one end for mounting to a support, such as a building wall, and an opposing end with an internally threaded opening. An insert structure is disposed within the open end of the rail, and a fastener extends through the insert into the internally threaded opening in the elbow. An expansible ring is carried by the insert structure within the open end of the rail, and is responsive to compression of the insert upon tightening of the fastener to expand radially outwardly against and frictionally engage the internal wall surface of the rail. The rail is thereby firmly fastened to the elbow.

In the preferred embodiments of the invention, the insert construction takes the form of axially opposed first and second insert sections disposed within the open end of the rail. At least one of the insert sections has an angulated surface surrounded by the expansible ring for urging the expansible ring outwardly against the internal wall surface of the rail when the insert sections are compressed toward each other by tightening of the fastener. In one embodiment of the invention, the expansible ring comprises a circumferentially continuous ring of elastic construction, such as an elastomeric O-ring. In another embodiment of the invention, the expansible ring takes the form of a resilient split ring having internal angulated surfaces that cooperate with external angulated surfaces on both of the insert sections for camming and expanding the split ring radially outwardly against the internal wall surface of the support rail. The fastener comprises a hex-head bolt, with the head being disposed in a hex-shaped pocket in one of the insert sections so that the bolt is held in position as the rail and elbow are threaded onto each other. In the preferred embodiment of the invention, the hex-shaped pocket is formed by the inside edges of six radially inwardly extending ribs at sixty degree spacing from each other within the insert section.

BRIEF DESCRIPTION OF THE DRAWINGS

The invention, together additional objects, features and advantages thereof, will be best understood from the following description, the appended claims and the accompanying drawings in which:

DETAILED DESCRIPTION OF PREFERRED EMBODIMENTS

Figure 1:
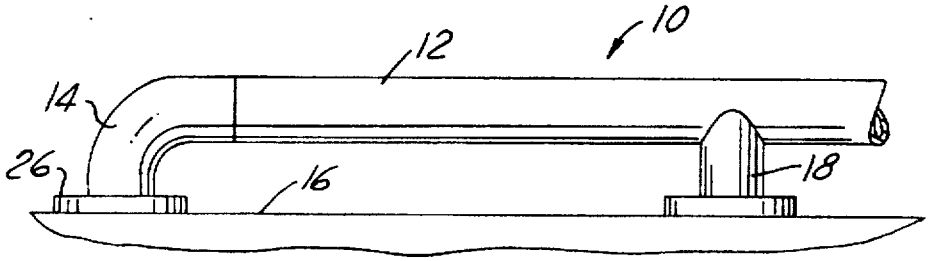
FIG. 1 is a fragmentary plan view of a support rail assembly embodying the invention.

FIG. 1 illustrates a support rail assembly 10 in which a tubular rail 12 has spaced ends (only one being shown) affixed by an elbow 14 to a wall surface 16. An additional center support 18 is illustrated and may be employed if necessary, but is not required. Elbow section 14 is illustrated in the drawings as a ninety degree elbow, although elbow sections of other constructions may be employed. Elbow 14 preferably is of molded plastic composition. Rail 12 may comprise an elongated length of plastic or metal tube stock, with an outer surface that is either smooth or serrated for providing a non-slip gripping surface.

Figure 2:
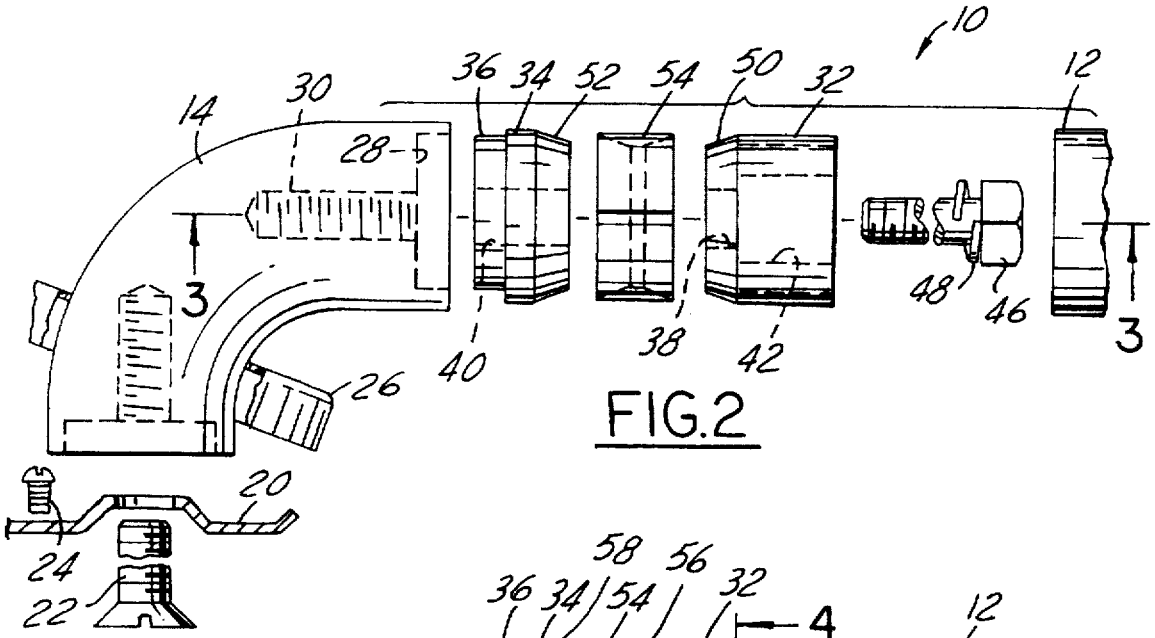
FIG. 2 is a fragmentary exploded assembly view of one embodiment of the invention.
Figure 3:
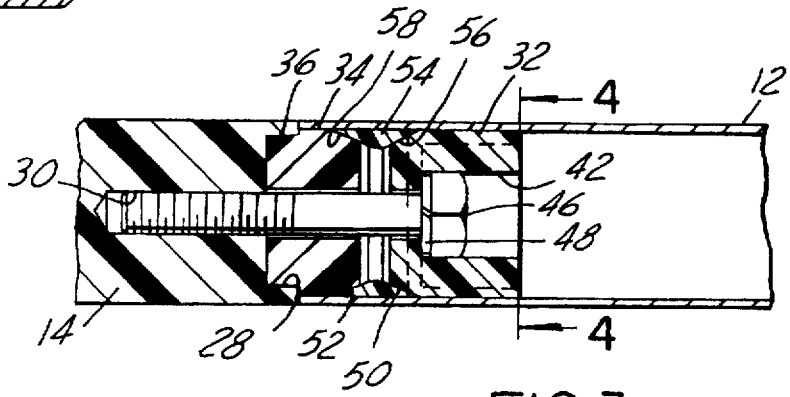
FIG. 3 is a fragmentary sectional view taken substantially along the line 3—3 in FIG. 2.
Figure 4:
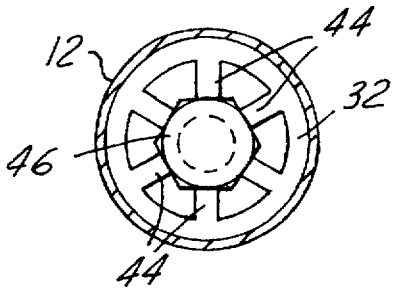
FIG. 4 is a sectional view taken substantially along the line 4—4 in FIG. 3.

Referring to FIGS. 2–4, amounting plate 20 is fastened to one end of elbow 14 by a screw 22, and in turn receives screws 24 for mounting plate 20 to wall surface 16 (FIG. 1). A plastic cover 26 is slidably disposed on elbow 14 for concealing mounting plate 20. The opposing end of elbow 14 has an internal shoulder 28 and an internally threaded opening 30 that extends into the body of the elbow. The opposing end of rail 12 is open, as best seen in FIGS. 3 and 4.

A pair of molded plastic insert sections 32,34 are positioned within the open end of tubular rail 12. Insert section 34 has a portion 36 of reduced diameter received within pocket 28 of elbow 14. Insert sections 32,34 have aligned through-openings 38,40. Opening 38 in insert section 32 opens into a hex-shaped pocket 42 defined by the inner ends of six radially inwardly extending ribs 44 at sixty degree spacing from each other within insert section 32. A hex-head bolt 46 and a high-collar lock washer 48 are received within openings 42,38 of insert section 32, with the shank of bolt 46 extending through openings 38,40 into internally threaded opening 30 of elbow 14. The axially opposed ends of insert sections 32 34 have respective radially outwardly facing axially angulated surfaces 50,52 adjacent to each other. A split ring 54 of resilient plastic composition is disposed between insert sections 32,34 so as to surround insert section surfaces 50,52. Split ring 54 has internal angulated surfaces 56,58 opposed to surfaces 50,52 of insert sections 32,34 respectively. The outer surface of split ring 54 of cylindrical geometry.

In assembly, lock washer 48, insert sections 32,34 and split ring 54 are assembled onto bolt 46, and bolt 46 is loosely threaded into opening 30 of elbow 14. The open end of rail 12 is then fitted over insert sections 32,34 and split ring 54. Elbow 14 is then rotated with respect to rail 12 (or rail 12 is rotated with respect to elbow 14) so as to tighten bolt 46 into opening 30 of elbow 14. As the bolt is tightened, insert sections 32,34 are compressed toward each other, and insert section surfaces 50,52 cooperate with surfaces 56,58 on split ring 54 to expand the split ring radially outwardly into frictional engagement with the internal wall surface of rail 12. In this way, rail 12 is firmly fastened to elbow 14.

Figure 5:
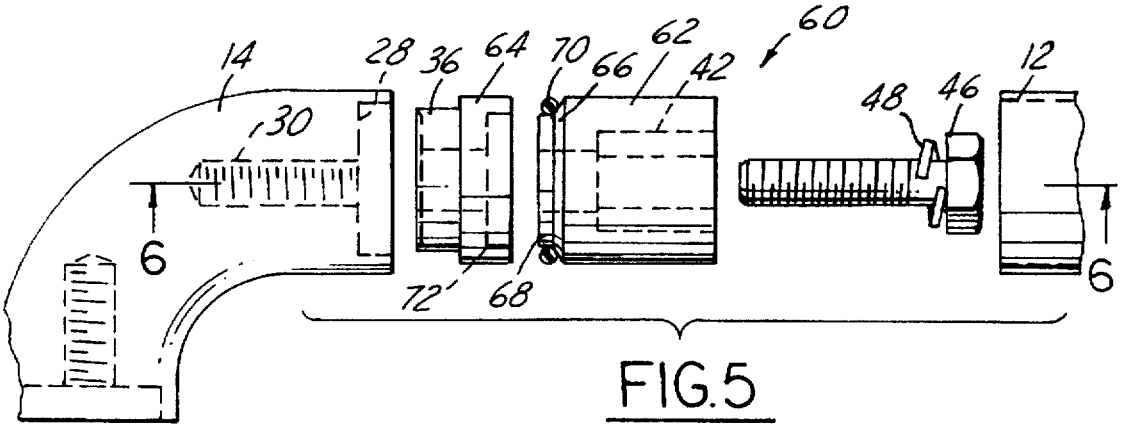
FIG. 5 is a fragmentary exploded assembly view of a second embodiment of the invention.
Figure 6:
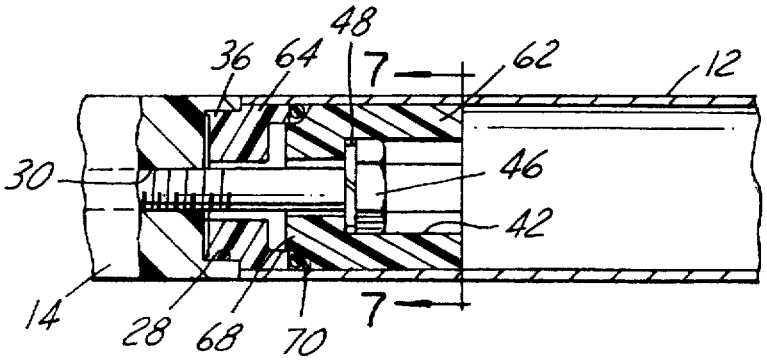
FIG. 6 is a fragmentary sectional view taken substantially along the line 6—6 in FIG. 5.
Figure 7:
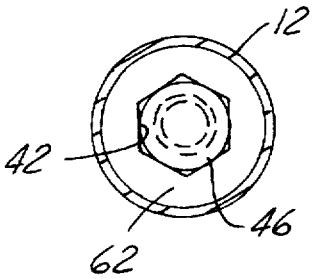
FIG. 7 is a sectional view taken substantially along the line 7—7 in FIG. 6.

FIGS. 5–7 illustrate a modular support rail assembly 60 in accordance with a modified embodiment of the invention, in which reference numerals identical to those employed in connection with FIGS. 1–4 indicate identical elements. In assembly 60, a pair of axially opposed insert sections 62,64 are provided. Insert section 64 has a section 36 of reduced diameter that fits within pocket 28 of elbow 14. Insert section 62 has an angulated surface 66 and a step-down shoulder 68 that carries an elastomeric O-ring 70. Insert section 64 has an internal pocket 72 sized to receive step-down shoulder 68 of section 62. In assembly, O-ring 70 is assembled to insert section 62 as illustrated in FIG. 5, and lock ring 48, insert section 62 and insert section 64 are mounted on the shank of bolt 46. Bolt 46 is then loosely threaded into opening 30 on elbow 14, and tubular rail 12 is fitted over the insert sections. Relative rotation of rail 12 and elbow 14 tightens bolt 46 into opening 30, compressing insert sections 62,64 toward each other. The lip of insert section 64 surrounding pocket 72 urges O-ring 70 radially outwardly along angulated surface 66 of insert section 62 into frictional engagement with the internal wall surface of tubular rail 12. Thus, once again, rail 12 and elbow 14 are firmly fastened to each other.

The invention claimed is:

1. A modular support rail assembly that comprises:

a rail having an open end with an internal wall surface, an elbow with means at one end for mounting to a support and means at an opposing end with an internally threaded opening, an insert including first and second axially opposed insert sections within said open end of said rail, fastener means including a hex-head bolt extending through said insert into said internally threaded opening in said elbow, said first insert section having a hex-shaped pocket for receiving the head of said bolt, and expansible means carried by said insert within said open end of said rail, at least one of said insert sections having an angulated surface surrounded by said expansible means for urging said expansible means outwardly against said wall surface, said expansible means being responsive to compression of said insert upon tightening of said fastener means into said opening to expand said expansible means radially outwardly against and frictionally engage said internal wall surface of said rail.

2. The assembly set forth in claim 1 wherein said expansible means comprises a circumferentially continuous ring of elastic construction.

3. The assembly set forth in claim 1 wherein said expansible means comprises a split ring.

4. The assembly set forth in claim 3 wherein said first and second insert sections have opposed radially outwardly oriented angulated surfaces, and wherein said split ring has oppositely oriented angulated internal surfaces respectively engaged by said angulated surfaces on said insert sections.

5. The assembly set forth in claim 1 wherein said pocket is defined by six radially extending ribs at sixty degree spacing from each other within said first insert section.

6. An insert assembly for use in constructing a modular rail assembly with a rail having an open end with an internal wall surface and an elbow with means at one end for mounting to a support and means at an opposing end with an internally threaded opening, said insert assembly comprising:

an insert with first and second axially opposed insert sections for positioning within said open end of the rail, a threaded fastener for extending through said insert into the internally threaded opening in the elbow, said threaded fastener having a hexagonal head and said first insert section having a hexagonal pocket for receiving the head of said fastener, and expansible means adapted to be carried by said insert within said open end of said rail, at least one of said insert sections having an angulated surface surrounded by said expansible means for urging said expansible means outwardly against said wall surface, said expansible means being responsive to compression of said insert upon tightening of said fastener into the elbow opening to expand radially outwardly against and frictionally engage the internal wall surface of the rail.

7. The assembly set forth in claim 6 wherein said expansible means comprises a circumferentially continuous ring of elastic construction.

8. The assembly set forth in claim 6 wherein said expansible means comprises a split ring.

9. The assembly set forth in claim 8 wherein said first and second insert sections have opposed radially outwardly oriented angulated surfaces, and wherein said split ring has oppositely oriented angulated internal surfaces respectively engaged by said angulated surfaces on said insert sections.

10. The assembly set forth in claim 6 wherein said pocket is defined by six radially extending ribs at sixty degree spacing from each other within said first insert section.

* * * * *